US007077287B2

(12) United States Patent
Lanz

(10) Patent No.: US 7,077,287 B2
(45) Date of Patent: Jul. 18, 2006

(54) DISPENSER PARTICULARLY, BUT NOT EXCLUSIVELY, FOR CIGARETTE PACKETS

(75) Inventor: Klaus Heinrich Lanz, Montague Gardens (ZA)

(73) Assignee: Vinallti (Proprietary) Limited, Montague Gardens (ZA)

( * ) Notice: Subject to any disclaimer, the term of this patent is extended or adjusted under 35 U.S.C. 154(b) by 82 days.

(21) Appl. No.: 10/917,488

(22) Filed: Aug. 13, 2004

(65) Prior Publication Data

US 2005/0035139 A1 Feb. 17, 2005

(30) Foreign Application Priority Data

Aug. 13, 2003 (ZA) ..... 03/6255
Aug. 13, 2003 (ZA) ..... 03/6256

(51) Int. Cl.
*G07F 11/00* (2006.01)

(52) U.S. Cl. ..... 221/192; 221/253; 221/155

(58) Field of Classification Search ..... 221/119, 221/125, 124, 129, 176, 182, 191, 192, 218, 221/253, 279, 123, 197, 198, 226, 232, 233; 222/190

See application file for complete search history.

(56) References Cited

U.S. PATENT DOCUMENTS 4,962,867 A 10/1990 Ficken et al.
5,046,641 A * 9/1991 Gray ..... 221/253

FOREIGN PATENT DOCUMENTS

| | | |
|---|---|---|
| DE | 196 04 561 | 8/1997 |
| DE | 198 46 791 | 4/2000 |
| GB | 467584 | 6/1937 |
| WO | WO 99/04375 | 1/1999 |

* cited by examiner

*Primary Examiner*—Gene O. Crawford
*Assistant Examiner*—Timothy Waggoner
(74) *Attorney, Agent, or Firm*—Douglas E. Jackson; Stites & Harbison PLLC

(57) ABSTRACT

A dispenser for dispensing packets particularly, but not exclusively cigarette packets is disclosed. The dispenser comprises a number of magazines for holding a plurality of packets standing in an upright position and a pusher for moving the plurality of packets towards a dispensing end of the magazine. There is a column at the dispensing end of the magazine. An arrangement is provided for lifting the front packet of the plurality upwards out of the magazine and there is a latch for preventing the lifted packet from dropping back down the column. The lifting arrangement comprising an endless element entrained around guides so as to provide a vertical run. There is at least one lifting lug carried by the endless element which is driven so that the lug lifts the front packet into the column. In another form the packets are horizontal and in a vertical stack. The endless element is below the stack and, when driven, strips the lowermost packet off the stack and pushes into the column. In another form dispensing is through a transparent door at the front of the horizontal magazine. The door tilts forward to open it. The front packet rests on a shelf of the door and is thus tilted with the door to present it to the customer when the door opens.

1 Claim, 13 Drawing Sheets

DISPENSER PARTICULARLY, BUT NOT EXCLUSIVELY, FOR CIGARETTE PACKETS

FIELD OF THE INVENTION

THIS INVENTION relates to dispensers particularly, but not exclusively, for cigarette packets.

BACKGROUND TO THE INVENTION

Various factors, such as restrictive legislation and the need to make the best possible use of space in retail outlets, has given rise to a need for a dispenser which can not only store a number of packets but can also display the front face of at least one packet and dispense packets one at a time to customers.

The present invention seeks to provide such a dispenser which will store packets and dispense them one at a time. It also seeks to provide, as a subsidiary feature, a dispenser in which at least one packet's front face is displayed for advertising purposes.

The present invention further seeks to provide means for producing data relating to the dispensing of cigarette packets as well as means to prevent tampering and/or theft.

BRIEF DESCRIPTION OF THE INVENTION

According to one aspect of the present invention there is provided a dispenser for dispensing packets particularly, but not exclusively cigarette packets, said dispenser comprising a magazine for holding a plurality of packets standing in an upright position, means for pushing the plurality of packets towards a dispensing end of the magazine, means defining a column at said dispensing end of the magazine, means for lifting the front packet of the plurality upwards out of the magazine and means for preventing the lifted packet from dropping back down said column, characterized in that said means for lifting the packet comprises an endless element entrained around guides so as to provide a vertical run, at least one lifting lug carried by the endless element, and means for driving said element so that said lug lifts the front packet into said column.

Said element can be a toothed belt or a chain and said guides can be toothed sprockets or chain sprockets.

The drive means can comprise an electric motor and a gearbox, the gearbox having an output shaft on which one of said sprockets is mounted.

The casing of the motor can be cylindrical in form and one of the sprockets of the endless element of the adjacent magazine can rotate using said casing as a hub.

In the preferred form there is an upper motor and gearbox driving the endless element of one magazine and a lower motor and gearbox driving the endless element of the adjacent magazine, the casing of the upper motor forming a hub for said endless element of the adjacent magazine, and the casing of the lower motor forming a hub for the endless element of said one magazine.

Control means can be provided for activating the motor associated with a magazine from which a packet is to be dispensed, there being means for detecting that the element has moved far enough to lift a packet into the column and deactivating the motor.

Said means for preventing said packet dropping back down the column can comprise at least one pivotally mounted latch which is displaced to an inoperative position by the packet being lifted by the lug and is held in its inoperative position by the packet until the packet has risen above the latch, said latch including a support surface onto which the packet drops when the lug disengages from the packet and the latch returns to its operative position. Said latch can be spring loaded back to its operative position, and there can be more than one latch for each column.

Means can be provided for electronically recording each operation of the motor. Means can also be provided for detecting the position of the pushing means in the magazine.

Switches can be provided at the upper ends of the columns, each switch being operated when a packet is lifted through the open top of the column.

According to another aspect of the present invention there is provided a dispenser for packets particularly, but not exclusively, cigarette packets, the dispenser comprising a magazine for holding a stack of packets each of which is in a horizontal position, an endless element supporting said stack, means for intermittently advancing the endless element to strip the lowermost packet from the stack and feed it forward, a display column, guide means for guiding a packing fed forward by said element into the lower end of said column whilst changing its orientation from horizontal to vertical, and a latch for preventing a packet that has entered the lower end of the column from falling back.

According to a further aspect of the present invention there is provided a dispenser for packets, the dispenser comprising a magazine for receiving a row of packets, means for pushing the row of packets in a forward direction, a transparent door behind which the first packet in the row stands, and means for opening the door so that said first packet can be removed from the dispenser, for closing the door after the packet has been removed and for locking the door closed.

Said door is preferably mounted for tilting movement about an axis at the lower end of the door. The axis is preferably rearwardly of a front panel of the door. The front panel can be transparent.

Spring means can be provided for closing the door. Cam means can be provided for tilting the door to its open position.

The cam means can be a rotatable cam which has a first cam surface or tilting the door to its open position and a second surface for locking the door against opening.

Said door can include surfaces on which the packet to be dispensed next stands, said surfaces forming part of the door so that said packet tilts when the door opens.

Means can be provided for detecting each opening of the door and storing the information in a control system, and means can be provided for determining where said pusher assembly is in the magazine.

BRIEF DESCRIPTION OF THE DRAWINGS

For a better understanding of the present invention, and to show how the same may be carried into effect, reference will now be made, by way of example, to the accompanying drawings in which:—

DETAILED DESCRIPTION OF THE DRAWINGS

Figure 1:
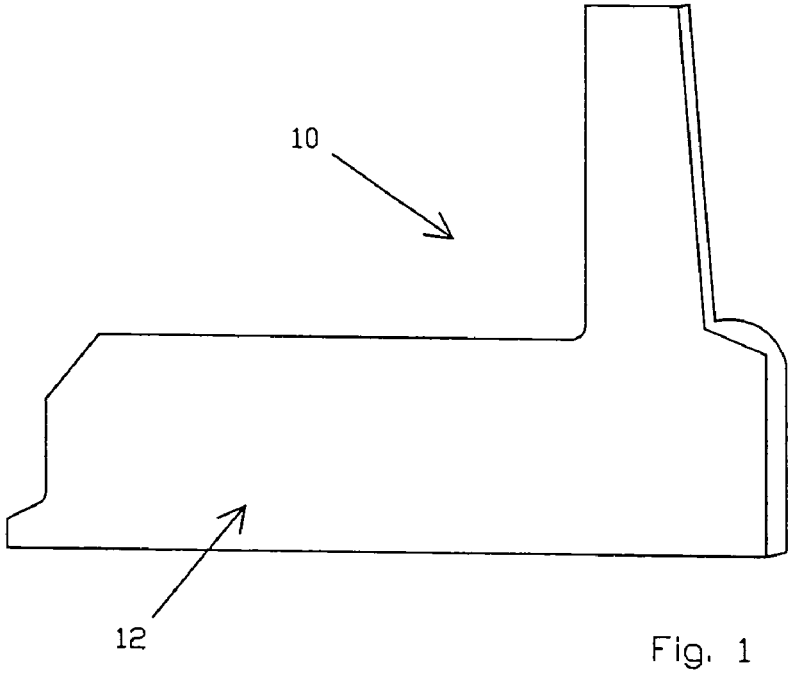
FIG. 1 is a side view of a dispenser in accordance with the present invention.
Figure 2:
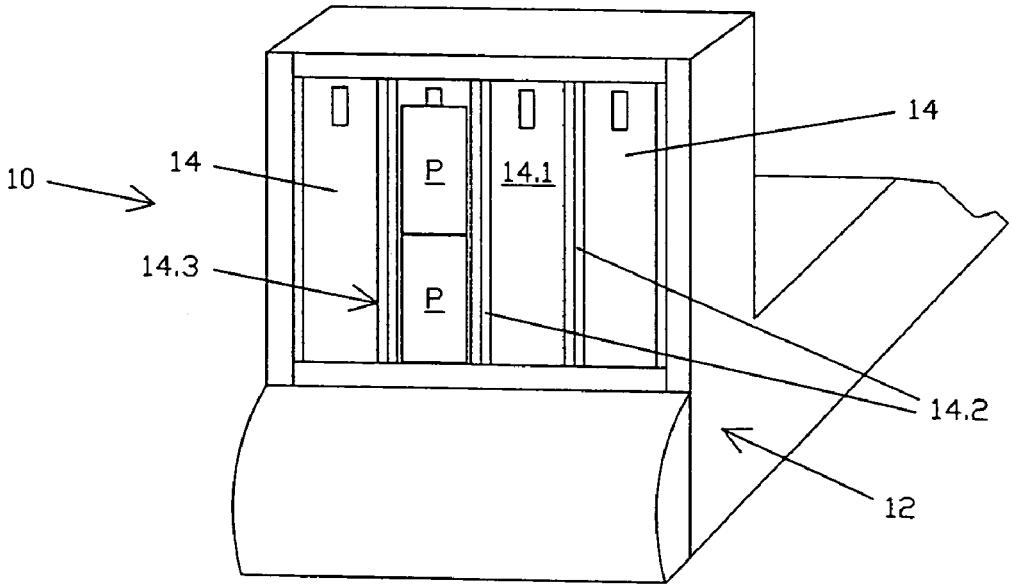
FIG. 2 is a pictorial front view of the dispenser.

The dispenser 10 illustrated in FIGS. 1 and 2 comprises a casing 12 which has transparent a window at the front through which packets P can be seen. The packets P are stacked in side-by-side columns 14. In the illustrated embodiment there are four columns 14. Only two packets P are shown in FIG. 2.

Each column 14 is bounded by a rear panel 14.1 and two posts 14.2. The edge zones of a packet in a column 14 are behind flanges 14.3 of the posts 14.2.

At the upper end of each column 14 there is a pivotally mounted lid (not shown). The lid is lifted by a packet emerging from a column 14 and drops back into its closed position when the packet is removed.

A switch 15 is provided at the upper end of each column 14. The switch 15 is operated each time a packet is dispensed and forms part of the dispenser's control system by providing a count of packets dispensed.

A side-by-side row of magazines 16 (FIG. 3) extend from front to rear within the casing 12. The magazines 16 are separated from one another by side walls 18 and each magazine 16 has a two part base 20 with a slot 22 between the parts. The bases 20 are bent upwardly and then horizontally to form guides 24 for a pusher assembly designated 26.

The pusher assembly 26 comprises a vertical front plate 28 and a housing 30 for an elongate leaf spring (not shown). One end of the spring is anchored to a rotatable reel (not shown) within the housing 30. The other end of the spring is anchored at a point at the front end of the magazine 16.

The pusher assembly 26 has a slot 36 on each side thereof, the guides 24 being in the slots 36 whereby the pusher assembly 26 is guided in its horizontal movements and is prevented from tilting.

A wire 35 is entrained around a pulley (not shown) of the pusher assembly 26 and around a pulley 37 at the rear of the magazine 16. The pulley 37 drives the rotary part of a potentiometer 39.

Each magazine 16 is loaded by pulling the pusher assembly 26 to the rear of the respective magazine 16. This unreels the leaf spring. Packets are then stood on the two part base 22 and the assembly 26 released so that it presses the packets towards the front end of the magazine 16.

The operating mechanism 38 of two adjacent columns 14 will be described, the remaining mechanisms 38 being identical.

Figure 5:
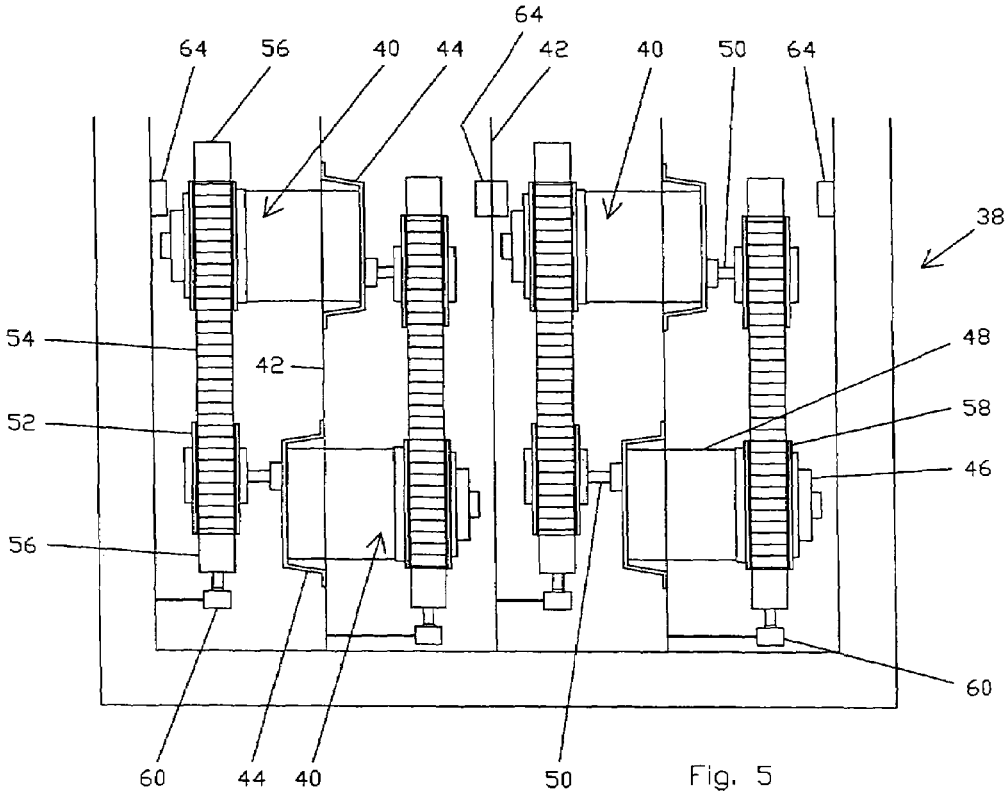
FIG. 5 is a view of two packet lifting systems to a larger scale than that of FIG. 4.

The operating mechanism 38 comprises upper and lower electric motors and gearboxes 40 (FIG. 5) which are mounted in vertically spaced openings in a dividing wall 42 by means of brackets 44. Each motor and gearbox 40 comprises a smaller diameter cylindrical casing 46 which houses the motor and a larger diameter cylindrical casing 48 which houses the gearbox. The output shaft 50 of each gearbox is at an off centre position.

A toothed sprocket 52 is fixed to each output shaft 50. Toothed belts 54 each having two lifting lugs 56 are entrained around the toothed sprockets 52.

Further toothed sprockets 58 are slid onto the casings 46 of the electric motors. The casings 46 serve as hubs for the sprockets 58.

A micro switch 60 is provided in conjunction with each belt 54, the micro switch 60 detecting each lifting lug 56 as it reaches a position close to the bottom dead centre point of the belt's travel.

Figure 3:
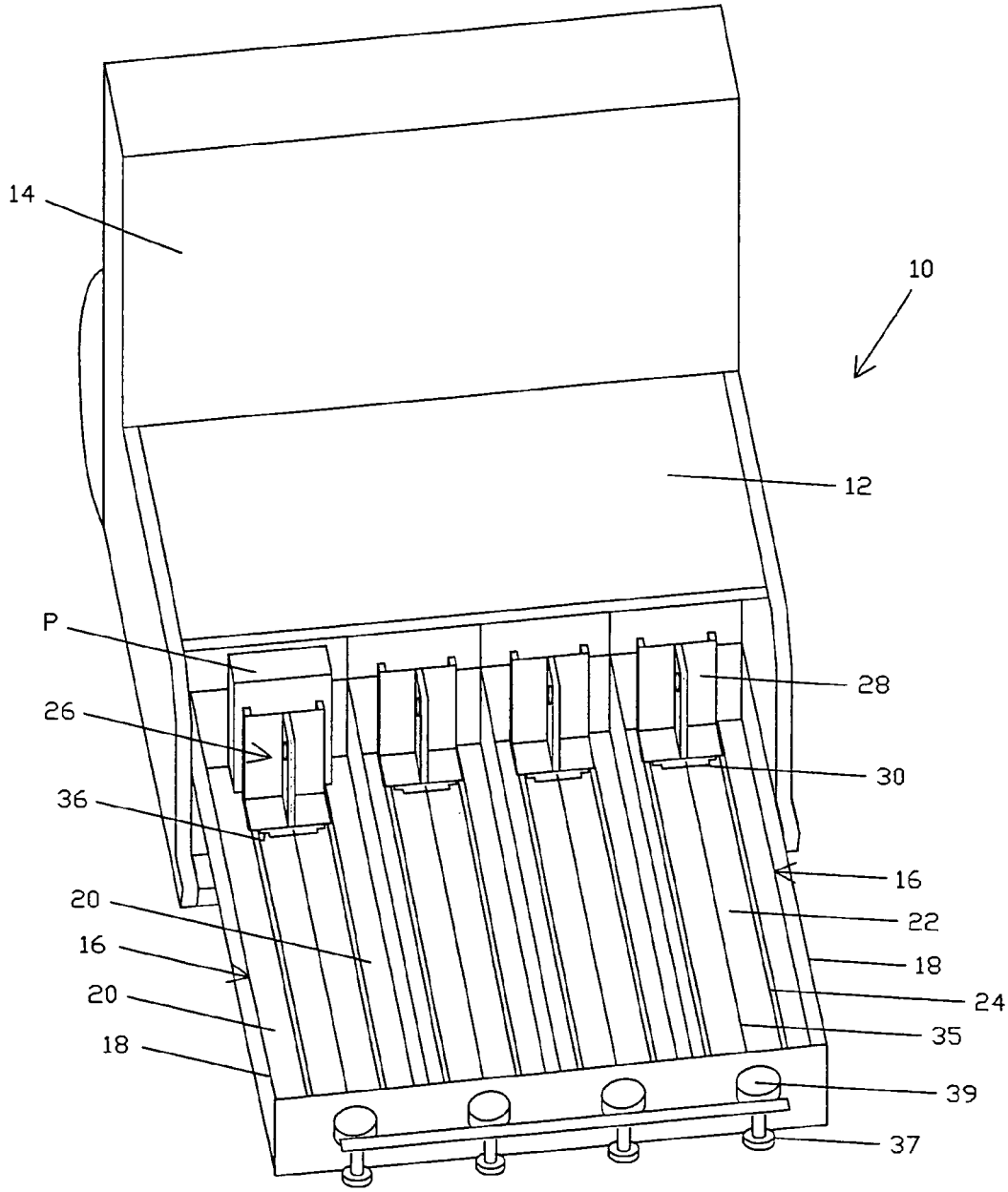
FIG. 3 is a view looking towards the front of the dispenser and showing the dispenser's magazines.

At the front end of each magazine 16 there are two inwardly directed flanges 62 (FIG. 3). These, as will be described, form stops which limit forward movement of the front packet in the magazine 16.

Figure 4:
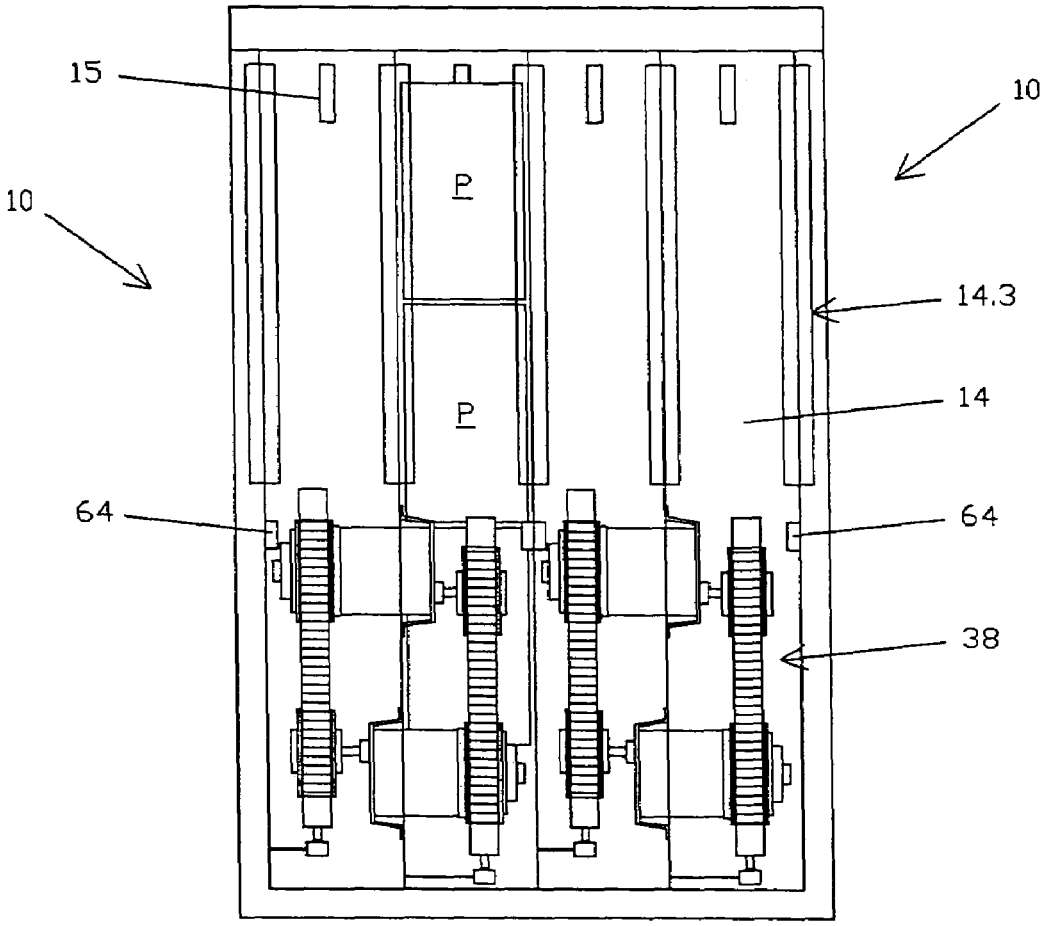
FIG. 4 is a front view of the operating mechanisms of the dispenser of FIG. 1.

At the lower end of each column 14 there are two latches 64. One latch 64 of each column 14 is visible in FIGS. 4 and 5, the other latch 64 is located behind the motor and gearbox 40. The latches 64 permit the front packet in the magazine 16 to be lifted into the column 14 and then prevent the packet dropping back down. The latches 64 (see FIGS. 6*a* and 6*b*) have a support surface 72 and a downwardly facing cam surface 74 which intersects the support surfaces 72.

Figure 6A:
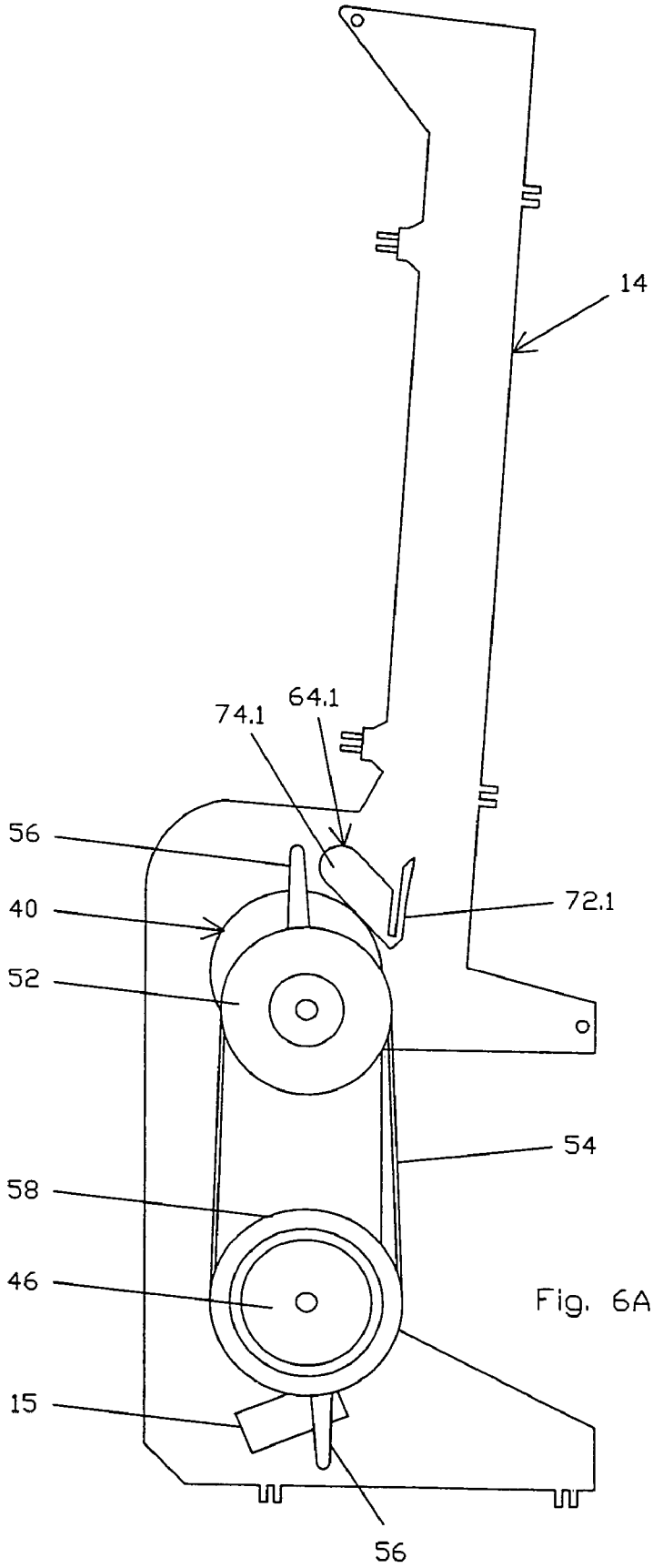
FIGS. 6*a* and 6*b* illustrate two means for preventing a packet dropping back down a column into which it has been lifted.
Figure 6B:
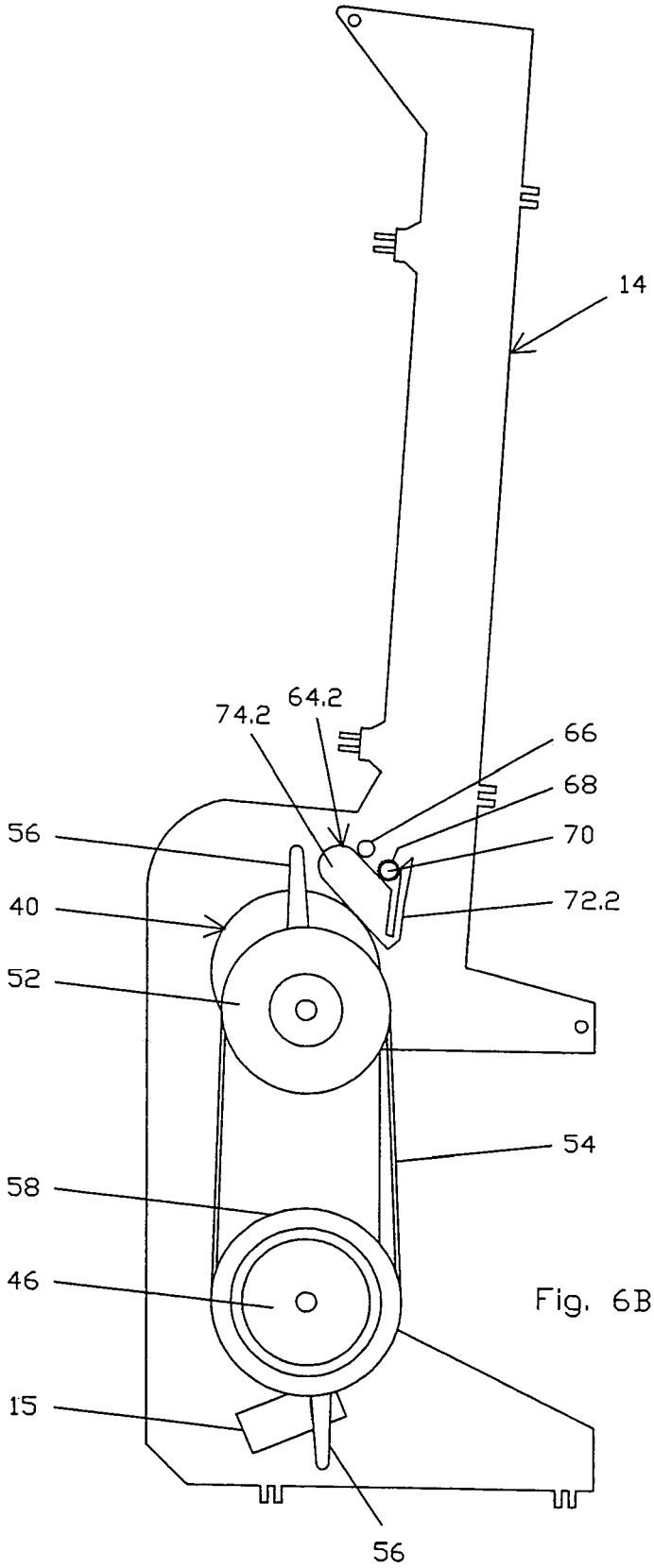

FIGS. 6*a* and 6*b* illustrate two alternative methods of using the latches 64 to prevent a lifted packet from dropping back down the column 14, as will be described in more detail hereinafter. The latch 64 is designated 64.1 in FIG. 6*a* and 64.2 in FIG. 6*b*.

The latch 64.1 (FIG. 6*a*) is secured to its corresponding dividing wall 42, whereas the latch 64.2 (FIG. 6*b*) is mounted for pivoting movement about a first spindle 66. A spring 68 has one end secured to the latch 64.2 and the other end secured to a second spindle 70 which is parallel to the first spindle 66. The spring 68 pulls the latch 64.2 to a position in which one end of the latch 64.2 bears on the second spindle 70, which thus acts as a stop. In this position the packet support surface 72.2 of the latch 64.2 is horizontal.

During operation of the dispenser 10, the pusher assemblies 26 push the front packets in the magazines 16 against the rear vertical runs of the belts 54. The front packets at this stage do not touch the flanges 62 at the forward ends of the magazines 16.

To dispense a packet, the appropriate control is activated and power is supplied to one of the electric motors. The vertical run of the belt 54 against which the packet is pressed moves upwards and the lug 56 which was in the bottom dead centre position moves upwards into contact with the lower surface of the front packet.

Referring specifically to FIG. 6*a*, as the packet lifts into the column 14 past the latch 64.1, the packet's leading edge is tilted forward due to the fact that the rear surface of the column 14 is slanted slightly rearwardly The lug 56 lifting the packet, as it moves around the top sprocket, moves out of contact with the lifted packet allowing it to drop down on the support surfaces 72.

Alternatively, if the latch 64.2 is used, as the packet lifts it encounters the cam surfaces 74.2 of the latches 64.2 and displaces the latches 64.2, against the action of the springs 68, out of the path of the packet being lifted. The packet can then move upwardly past the latches 64.2, lifting the two packets already in the column 14.

As the lower face of the packet moves out of contact with the cam surfaces 74.2, the springs 68 pull the latches 64.2 back to the position in which the support surfaces 72.2 are below the packet.

The lug 56 lifting the packet, as it moves around the top sprocket, moves out of contact with the lifted packet allowing it to drop down on the support surfaces 72.2. The other lug 56, as it reaches the bottom dead centre position, encounters the micro switch 60. The switch 60 opens and power supply to the motor ceases.

As one packet enters the lower end of a column 14, the top packet is lifted out of the top of the column 14 and is available to the customer.

The magazines 16 are on rails so that they can be slid out of the casing 12 for loading purposes once a door (not shown) in the rear of the casing 12 has been opened. As soon as the magazine 16 is pulled back, the front packet in the magazine 16 is pushed against the flanges 62 which limits its forward movement. When the magazine 16 is pushed forward, the front packet encounters the belt 54 which holds the packet clear of the flanges 62.

Figure 7:
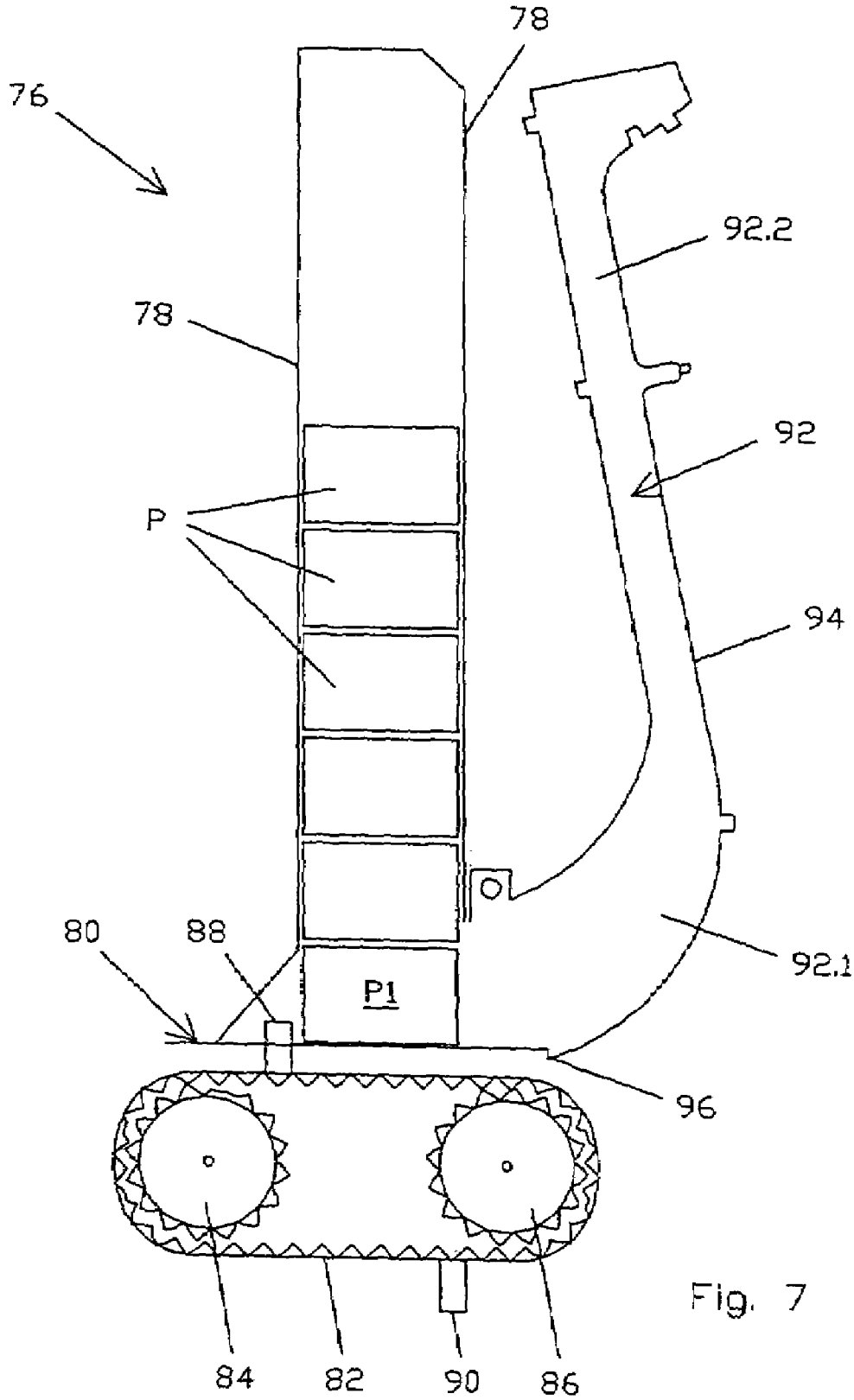
FIG. 7 illustrates the operating mechanism of another dispenser in accordance with the invention.

The dispenser 76 shown in FIG. 7 comprises vertical guides 78 forming a storage column in which a stack of packets P is contained. The packets P lie horizontally.

The lowermost packet P1 rests on a base plate 80 which has a slot (not shown) provided therein. A toothed belt 82, which is entrained around two sprockets 84, 86, is mounted below the base plate 80. The upper run of the belt 84 is aligned with the slot in the base plate 80 to allow lugs 88, 90 on the belt 82 to protrude therethrough.

A display column 92 comprises a lower part 92.1 which is essentially horizontal and an upper part 92.2 which is essentially vertical. The upper part 92.2 of the display column 92 has a transparent window 94 provided in front of the storage column formed by the guides 78. A ridge 96 is formed on the lower surface of the lower part 92.1 of the column 92.

During operation of the dispenser 76, the sprockets 84, 86 are turned by a motor (not shown) and the lowermost packet P1 is pushed forward into the lower part 92.1 of the display column 92 by the lug 88 carried by the rotating belt 82.

As the lug 88 reaches the end of the belt's travel and loses contact with the rear surface of the packet P1, the underneath surface of the packet P1 drops over the ridge 96. The ridge 96 prevents the packet P1 from sliding back out of the column 92.

During operation, the packet P1 being pushed forward by the lug 88 lifts other packets (not shown) in the column 92 vertically, and dispenses the top one from the upper end of the column 92.

Figure 8:
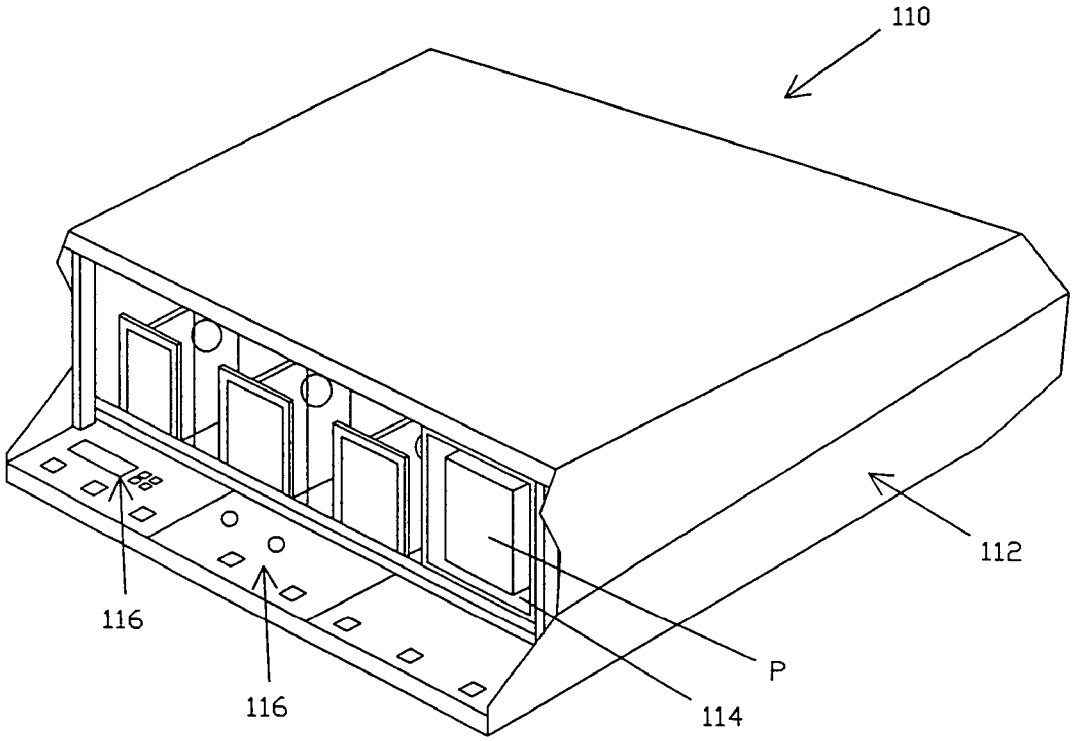
FIG. 8 is a pictorial view of a further dispenser in accordance with the invention.

The dispenser 110 illustrated in FIG. 8 comprises a casing 112 which has an open window 114 at the front through which a transverse row of packets P can be seen. Only one packet P is shown in FIG. 8. Controls for the dispenser 110 are shown at 116.

A side-by-side row of four magazines 118 (FIGS. 9 and 11) extend from front to rear within the casing 112. The magazines 118 are separated from one another by side walls 120 and each has a two part base 122 with a slot 124 between the parts of the bases 122. The bases 122 are bent upwardly and then horizontally (see FIG. 10) to form guides 126 for a pusher assembly designated 128.

The pusher assembly 128 comprises a vertical front plate 129 and a housing 130 for an elongate leaf spring 132. One end of the spring 132 is anchored to a rotatable reel (not shown) within the housing 130. The other end of the spring 132 is anchored at a point 131 (FIG. 11) close to the window 114.

The pusher assembly 128 has a slot 134 (FIG. 11) on each side thereof, the guides 126 being in these slots 134 whereby the pusher assembly 128 is guided in its horizontal movements and is prevented from tilting.

Figure 9:
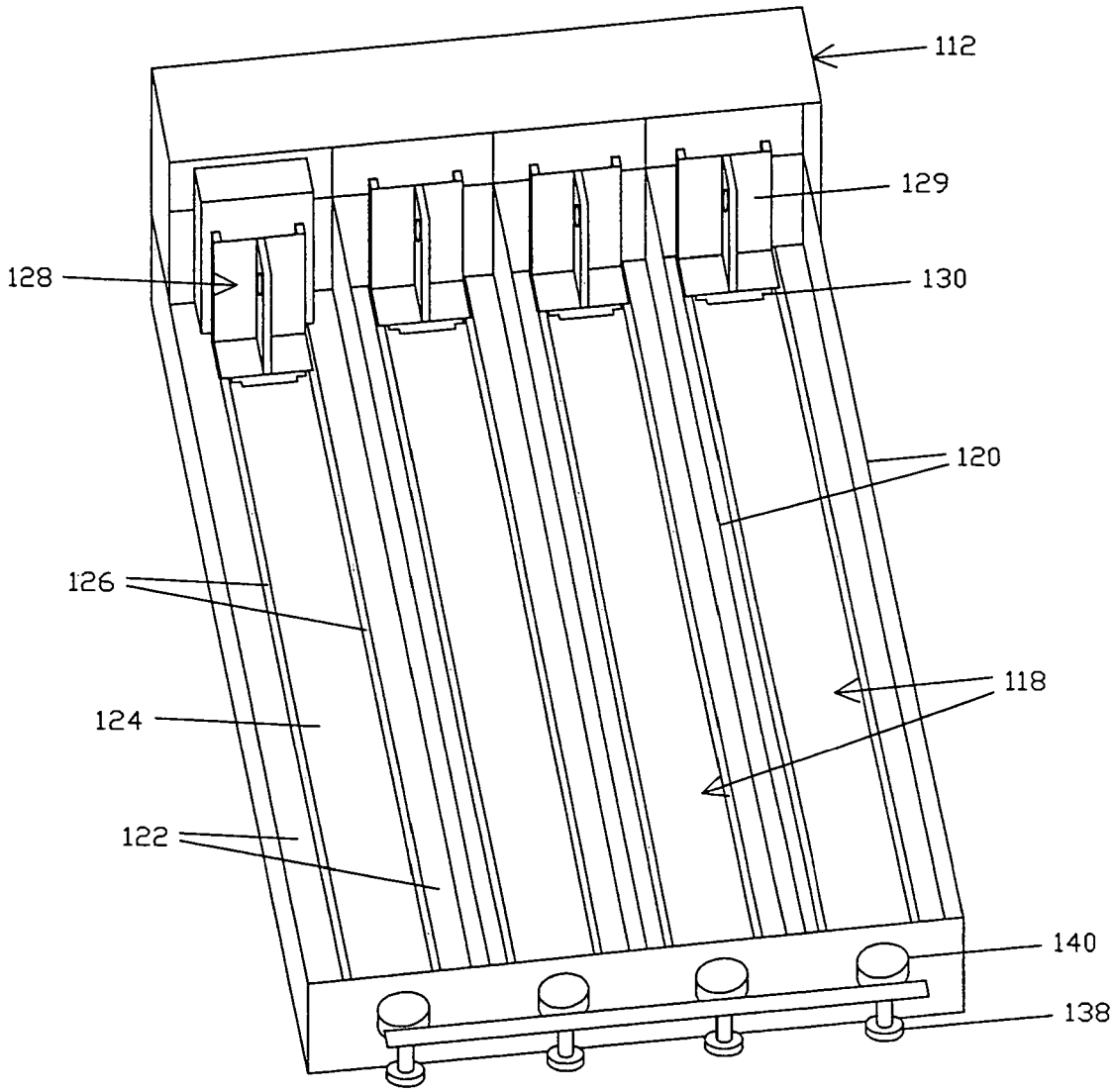
FIG. 9 is a view of the dispenser of FIG. 8 from the rear with the casing removed.
Figure 10:
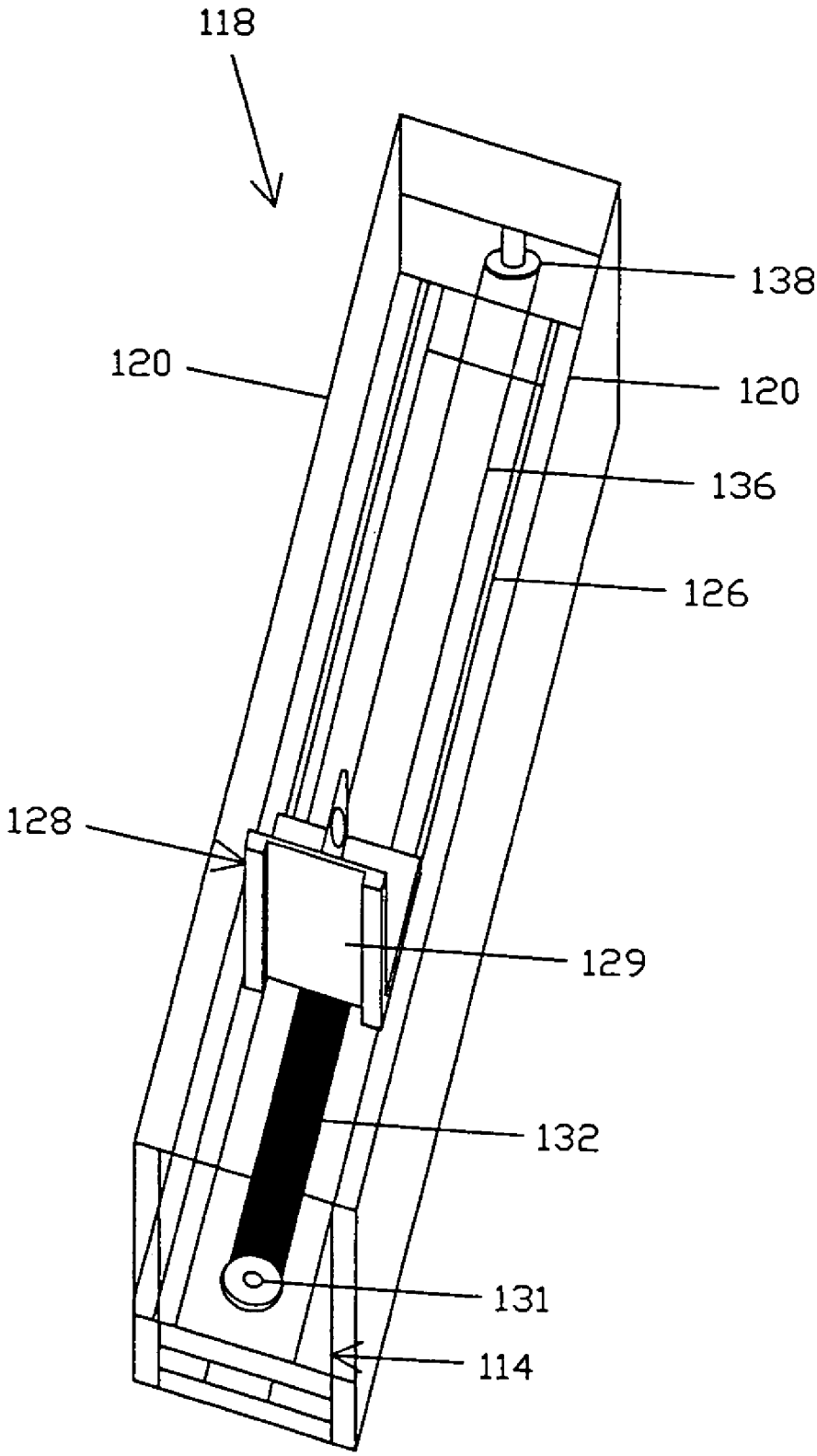
FIG. 10 is a pictorial view from the front of a single magazine.
Figure 11:
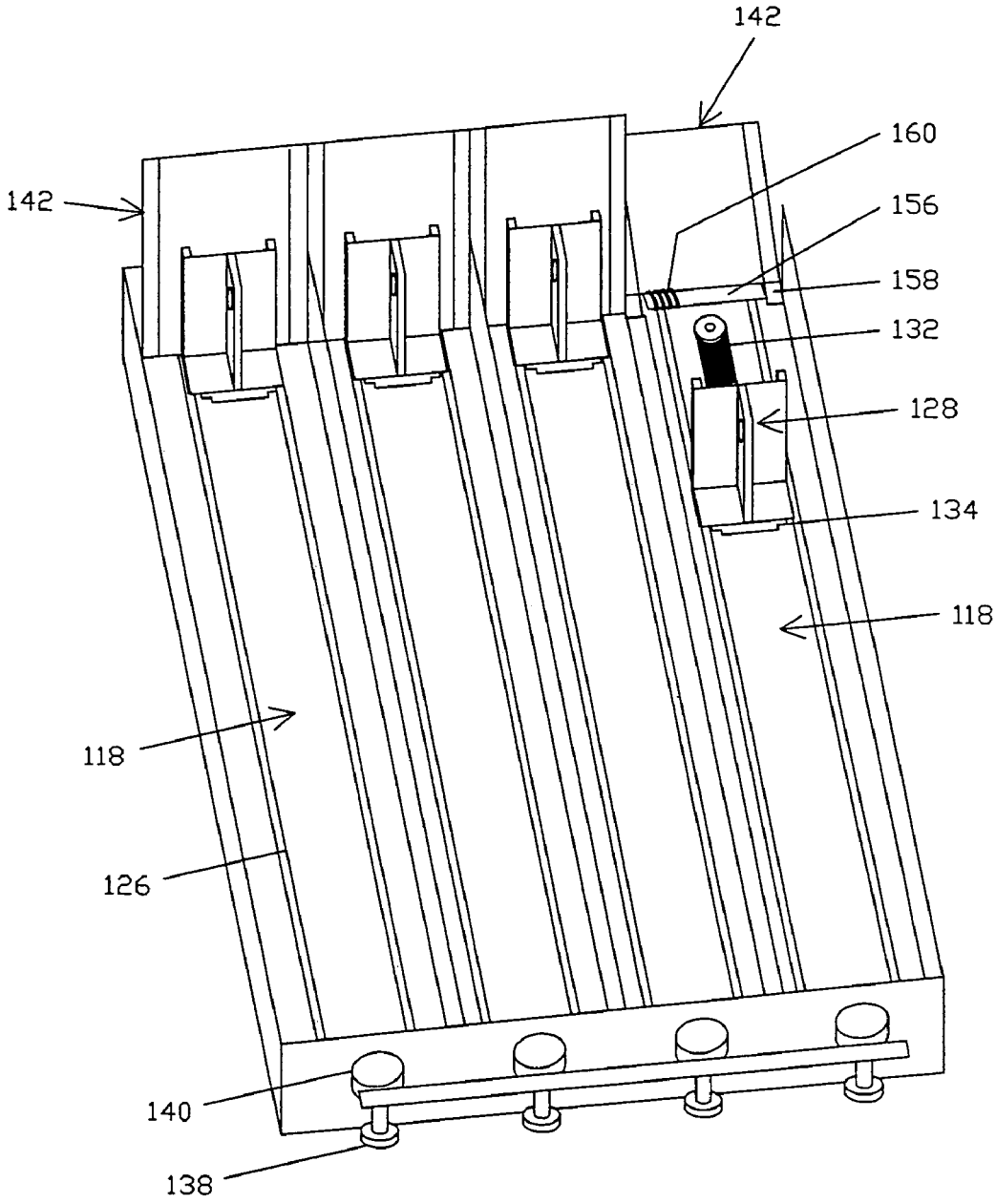
FIG. 11 is a pictorial view of the dispenser from the rear with the casing removed, showing the dispenser's magazines.

A wire 136 (FIG. 10) is entrained around a pulley (not shown) of the pusher assembly 128 and around a pulley 138 at the rear of the magazine 118. The pulley 138 drives the rotary part of a potentiometer 140 (FIGS. 9 and 11). The wires 136 have been omitted from FIGS. 9 and 11.

Each magazine 118 is loaded by pulling the pusher assembly 128 to the rear of the respective magazine 118. This unreels the leaf spring 132. Packets are then stood on the two part base 122 and the assembly 128 released so that it presses the packets towards the window 114.

Figure 12:
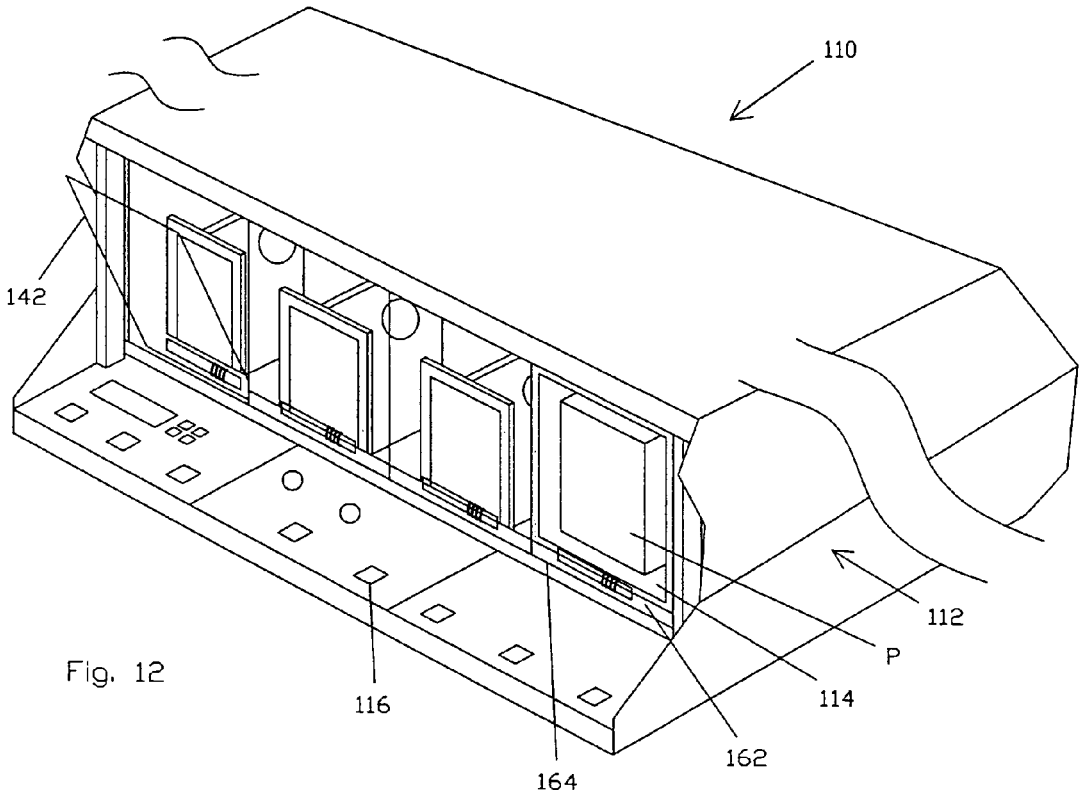
FIG. 12 is a pictorial view of the front of the dispenser.

At the front end of each magazine 118 there is a transparent door 142 and a mechanism 144 for opening the door 142 and dispensing a packet. In FIG. 12 one door 142 is shown in the open position and the remaining doors 142 are shown closed. The doors 142 have been omitted from FIG. 13. As will be seen from FIG. 8, the doors 142 are in a row across the open window 114.

Figure 13:
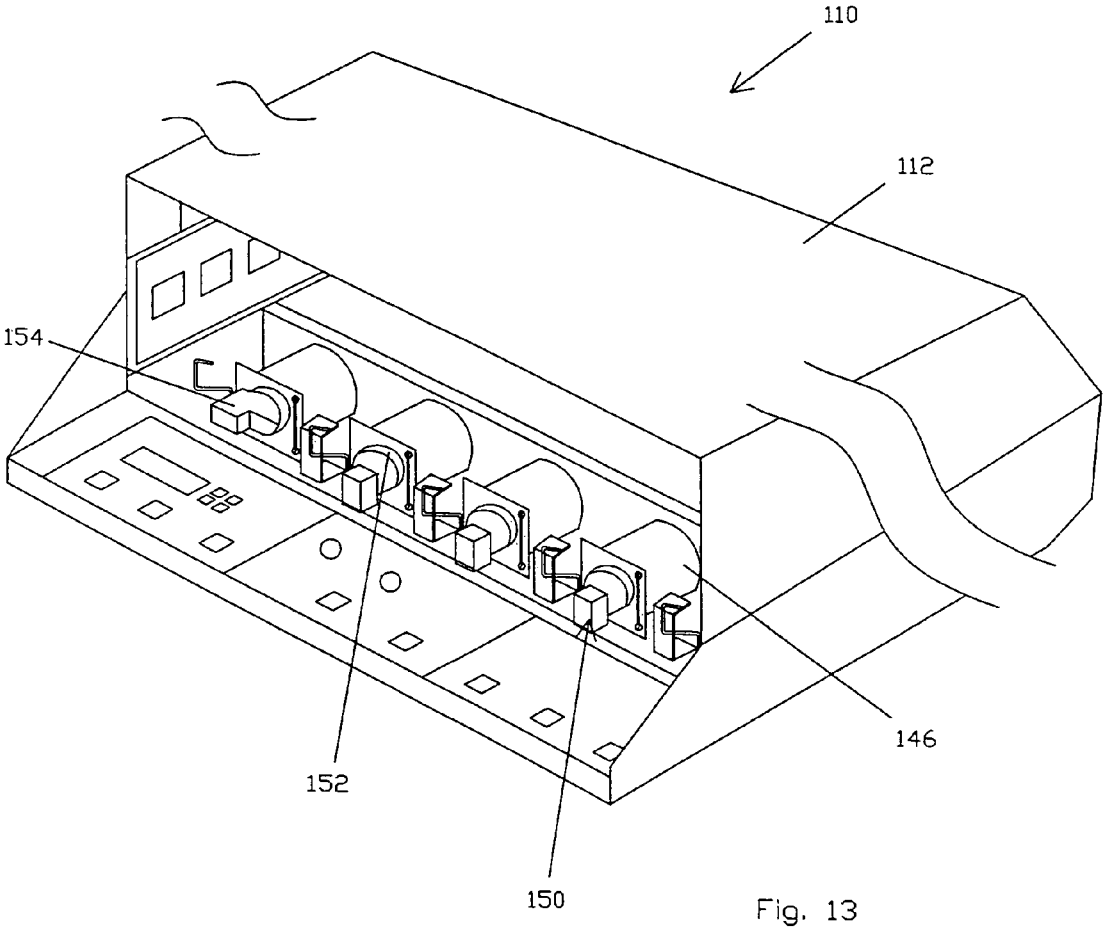
FIG. 13 is a view similar to FIG. 12 and showing a door opening and packet dispensing mechanism.

Referring now to FIG. 13, each door opening and dispensing mechanism 144 comprises a motor and gear box 146 mounted with its output shaft (not shown) horizontal. The motors and gear boxes 146 are below the bases 122 of the magazines 118. A cam 150 is mounted on each output shaft of the motor and gear box 146. Each cam 150 comprises a vertical surface 152 which co-operates with the associated door 142 to hold the door 142 closed. Each cam 150 further has a peripheral surface 154 which co-operates with the door 142 to force the door 142 to its open position.

In FIG. 13 the left hand cam 150 is shown in its operated position in which the associated door 142 (see FIGS. 11 and 12) is open. The remaining cams 150 are shown in the "door closed" position.

Each door 142 is pivotally mounted, at its lower end, on a spindle 156 which passes through holes in two arms 158 (FIG. 11) extending rearwardly at the lower end of the door 142. Only the spindle 156 associated with the right-hand door 142 is shown in FIG. 11.

The ends of the spindle 156 are mounted in the front end portions of the side walls 120 which are between the doors 142. Each spindle 156 passes through a coil spring 160, one end of the coil spring 160 being connected to the spindle 156 and the other to a fixed anchorage on the casing 112. The coil springs 160 pull the doors 142 to their closed positions.

Each door 142 extends downwardly below the spindle 156, the downward extension being designated 162 in FIG. 12. This extension 162 is behind a metal strip 164 which forms the cill of the window 114. The spring 160 pulls the downward extension 162 against the stop constituted by the strip 164.

At the ends thereof remote from the transparent front panel of the door 142, the arms 158 are joined by a cam follower 166. The top surfaces 168 of the arms 158 and the cam follower 166 form a support onto which the pusher assembly 128 pushes the front packet of the row in the magazine 118.

The cam follower 166 is above the cam surface 154 and against the vertical cam surface 152. The surface 152 prevents the associated door 142 tilting about its spindle 156 and thus prevents the door 142 moving to its open position. The cam follower 166 is, when the door 142 is closed, spaced from the surface 154.

It will be understood that when the assembly 128 is pulled to the rear for loading purposes, the rotatable part of the potentiometer 140 turns and the resistance value sensed by the electronic controls indicates that the magazine 118 is full. Each time a packet is dispensed, the assembly 128 moves forward and the wire 136 runs over the pulley 138 turning the rotatable part of the potentiometer 140. This change in resistance is sensed by the electronic controls and indicates that a packet has been dispensed because the pusher assembly 128 has been able to move forward.

To dispense a packet, the operator uses a tag which is exclusive to that operator and which is presented to the controls 116. Once the operator has been identified and recorded electronically, the relevant magazine 118 can be selected and the dispenser 110 operated so that the correct door 142 opens and a packet can be removed.

More specifically, the cam 150 rotates through about a right angle which moves the surface 152 out of co-operating relationship with the cam follower 166 of the door 142. The cam 154 can then tilt the door 142 to its open position by bearing on the cam follower 166. The supporting surfaces 168 on which the front packet of the row stands also tilts so that the packet follows the transparent front panel of the door 142 in moving to a tilted position. It can then be lifted from the dispenser 110. The surface 154 is shaped so that, on further rotation of the cam 150, it allows the spring 160 to tilt the door 142 back to its closed position.

The cam 150 continues to rotate until the surface 152 is in a position to co-operate with the cam follower 166 and lock the door 142. The surface 154 moves out of contact with the cam follower 166 of the door 142 and plays no part in locking the door 142. It is only operative in tilting the door 142 to the open position.

Whilst the door 142 is tilted, the lifted rear edge of the cam follower 166 prevents the next packet from being advanced onto the supporting surfaces 168. As soon as the support 168 is horizontal the packet which has become the first packet in the row moves onto the supporting surfaces 168.

A switch can be provided for enabling each door actuation to be recorded electronically.

The invention claimed is:

1. A dispenser for packets particularly, but not exclusively, cigarette packets, the dispenser comprising a magazine for holding a stack of packets each of which is in a horizontal position, an endless element supporting said stack, means for intermittently advancing the endless element to strip the lowermost packet from the stack and feed it forward, a display column, guide means for guiding a packing fed forward by said element into the lower end of said column whilst changing its orientation from horizontal to vertical, and a latch for preventing a packet that has entered the lower end of the column from falling back.

* * * * *